US008568352B2

(12) United States Patent
Al Thalab

(10) Patent No.: US 8,568,352 B2
(45) Date of Patent: Oct. 29, 2013

(54) NURSING DEVICE

(71) Applicant: Fatemah S. Al Thalab, Alandalous (KW)

(72) Inventor: Fatemah S. Al Thalab, Alandalous (KW)

( * ) Notice: Subject to any disclaimer, the term of this patent is extended or adjusted under 35 U.S.C. 154(b) by 0 days.

(21) Appl. No.: 13/784,763

(22) Filed: Mar. 4, 2013

(65) Prior Publication Data

US 2013/0186915 A1 Jul. 25, 2013

Related U.S. Application Data

(63) Continuation-in-part of application No. 11/370,045, filed on Mar. 8, 2006.

(51) Int. Cl.
*A61J 7/00* (2006.01)

(52) U.S. Cl.
USPC ..... 604/77; 606/236; 215/11.1

(58) Field of Classification Search
USPC ..... 604/76–78; 606/236; 215/11.1–11.6
See application file for complete search history.

(56) References Cited

U.S. PATENT DOCUMENTS

| | | | | |
|---|---|---|---|---|
| 4,077,405 | A | 3/1978 | Haerten et al. | |
| 4,397,639 | A | 8/1983 | Eschweiler et al. | |
| 4,722,734 | A | 2/1988 | Kolln | |
| 4,856,663 | A | 8/1989 | Epp | |
| 4,884,013 | A * | 11/1989 | Jackson et al. | 318/481 |
| 4,966,580 | A * | 10/1990 | Turner et al. | 604/67 |
| 5,531,338 | A * | 7/1996 | Sklar | 215/11.1 |
| 5,616,121 | A | 4/1997 | McKay | |
| 6,033,367 | A | 3/2000 | Goldfield | |
| 6,161,710 | A * | 12/2000 | Dieringer et al. | 215/11.4 |
| 6,537,244 | B2 | 3/2003 | Paukovits et al. | |
| 2003/0234235 | A1 * | 12/2003 | Renz | 215/11.1 |
| 2004/0188372 | A1 * | 9/2004 | Ruth et al. | 215/11.4 |
| 2007/0235405 | A1 | 10/2007 | Al-Thallab | |
| 2008/0039778 | A1 | 2/2008 | Goldie et al. | |

FOREIGN PATENT DOCUMENTS

| | | |
|---|---|---|
| FR | 2622102 | 4/1989 |

* cited by examiner

*Primary Examiner* — Emily Schmidt
(74) *Attorney, Agent, or Firm* — Richard C. Litman

(57) ABSTRACT

A nursing device for feeding infants with a cleft lip and/or cleft palate includes upper and lower portions. The upper portion includes a bottle with an opening in its top for containing a liquid, a nipple and a screw cap for maintaining the nipple in sealing engagement with the opening. A submersible pump is disposed in the bottom of the bottle and connected to an opening in the nipple by a tube. A lower portion of the device includes a motor and a magnetic coupling for activating the pump. A microprocessor control timer includes means for regulating the timing and flow of a feeding cycle with a display for help in regulating the feeding cycle. Alternatively, the motor, pump, controls, and power supply may be disposed at the top of the bottle as a removable unit.

5 Claims, 6 Drawing Sheets

NURSING DEVICE

CROSS REFERENCE TO RELATED PATENT APPLICATION

This application is a continuation-in-part of U.S. patent application Ser. No. 11/370,045 filed on Mar. 8, 2006.

FIELD OF THE INVENTION

This invention relates generally to a nursing device, and more particularly to a nursing bottle for infants with a cleft lip and/or cleft palate.

BACKGROUND OF THE INVENTION

Cleft lips and cleft palates are common birth defects and require special attention during the initial six months of a child's life. To be more specific, there are three types of cleft lip, i.e., unilateral incomplete, unilateral complete and bilateral complete. There are also three types of cleft palates, namely the soft palate only, the unilateral complete, and the bilateral complete. However, each of the cleft lip and/or cleft palate malformations involves leakage of air from the mouth through the nose, which causes an infant to be unable to suck, causing regurgitation of fluids through the nose and difficulty in swallowing and breathing.

For a period of about six months until the infant has matured enough for corrective surgery, the infant must be fed. Feeding is not only the most immediate problem encountered in the daily care of an infant with a cleft lip and/or cleft palate, but it is one of the more difficult to solve and the most necessary for the survival of the child.

A U.S. Pat. No. 4,856,663 of Epp discloses a nursing device for infants with a cleft lip or cleft palate. As disclosed, the device comprises a solid duckbill-shaped shield with an incorporated nipple on its underside, together with means for interconnecting the nipple and a baby bottle or breast. The shield acts to seal the cleft palate while keeping the nipple from collapsing into the cleft palate and cleft lip to allow an infant to suck liquids from a bottle or the breast.

A French Patent No. 2,622,102 A1 of Michel Grateau discloses a control device with feedback for artificial feeding systems for force-feeding of infants. The device that is fitted into a nursing bottle allows a caregiver to control the feeding device.

A more recent U.S. Pat. No. 6,033,367 of Goldfield discloses a smart bottle and system for neonatal nursing. The system for diagnosing or monitoring sucking/swallowing/breathing of an impaired neonate includes a processor for receiving a signal from a breath sensor. The system develops an output for intraoral tactical or flow control feedback. In a feeding or monitoring embodiment, the processor applies a signal to control a liquid feeding valve, which supplies nutrients through a feeding nipple. In another embodiment, adapted for manual feeding, the processor displays a waveform indicative of the breath or airflow sensor output, and a manually operated pressure bulb is provided to allow a nurse to apply arrhythmic muscular pressure stimulus via a feeding or surrogate nipple in a manner visually synchronized with the displayed breath activity.

Notwithstanding the above, it is presently believed that there is a need for and a commercial potential for an improved feeding device in accordance with the present invention. There should be a demand for such devices because the devices pump measured amounts of milk in pre-selected periods of time to overcome the difficulties in feeding children with cleft lips and cleft palates. Further, the devices in accordance with the invention include a nipple so that a baby can develop an ability to suck and, at the same time, to exercise and massage the muscles of the face. In some cases, a baby cannot cope with swallowing because of the defect in the palate. However, with the devices in accordance with the present invention, a nurse or mother can pump measured amounts of nutrient so that the child obtains enough nutrients in enough time without adversely affecting their general condition.

The devices in accordance with the present invention are also applicable for pre-natal infants, i.e., those born before 32 weeks. The suction reflex in such infants may not be fully developed, and the child may choke on nutrient from an ordinary bottle. Such choking may lead to infection. Further, the use of the present invention may allow the infant to leave the hospital at an earlier time, since the mother will be able to feed the child at home. Another advantage of the device is that it has a nipple that helps in developing a child's ability to suck.

Further, children with special needs that have a problem with swallowing may also benefit from the use of the devices in accordance with the invention. Still further, the devices avoid a problem associated with spilling relatively large amounts of milk during feeding. Also, such devices can be used to feed fluid foods to elderly people who are having feeding problems.

SUMMARY OF THE INVENTION

In essence, the present invention contemplates a nursing device or baby's bottle for feeding infants with a cleft lip or cleft palate. The nursing device includes an upper portion including a bottle for containing a supply of nutrients and/or water with an opening at one end thereof. The upper portion also includes a nipple and means for maintaining the nipple in sealing engagement with the top of the bottle. In a preferred embodiment of the invention, the top of the bottle includes a threaded neck portion around the opening and is adapted to receive a conventional cap thereon. The cap includes a central opening adapted to receive a nipple therein and internal threads for engaging the external threads on the bottle. Thus, tightening the cap squeezes a flange on the outer portion of the nipple between the top of the bottle and the underside of the cap to form a liquid-tight seal. A pump is disposed in the bottle below the surface of the liquid nutrient or water and preferably near or on the bottom of the bottle. Tubular means, such as a flexible hose or semi-rigid or rigid conduit, connects an output of the pump with a forward portion of the nipple for delivering preselected amounts of nutrients or water through the nipple and into an infant's mouth. A lower portion of the device includes a housing and a motor disposed in the housing for rotating the pump through a magnetic coupling. An important feature of the present invention resides in means, such as a timer, for regulating the amount of nutrient or water pumped in a given period of time. The timer may also include means for regulating the cycle.

Other embodiments comprise an attachment that secures removably to the threaded neck of a conventional nursing bottle or the like. The attachment has a base that threads onto the neck of the bottle, and a substantially sealed housing that contains an electric motor, controls, and an electrical storage battery power for the motor.

One embodiment includes the motor driven pump within the housing. The pump preferably is a peristaltic-type pump, wherein a rotary device travels along the outer surface of a length of flexible tube to compress the tube progressively and force liquid through the tube. Thus, the only liquid path through the housing comprises an unbroken length of flexible tubing extending through the floor of the housing and through the pump to the nipple, which extends from the top of the housing, to minimize the possibility of leakage within the housing.

Another embodiment places the pump below the floor of the housing. The pump has a magnetic rotor that is driven by a magnetic drive from the motor in order to preclude the need for a passage through the floor for a driveshaft. Again, the only liquid path through the housing comprises a tube extending from the pump through the floor of the housing and out the top of the housing to the nipple extending therefrom.

The top of the housing is configured for the threaded attachment of a conventional nursing bottle cap thereto. The cap serves to capture the base flange of a conventional nursing bottle nipple between the top of the housing and the inwardly disposed flange of the cap. Single or double nipples having the output end of the tube extending therethrough may be provided with any of the embodiments disclosed herein. The bottle is preferably conventional, and may have a neck disposed coaxially with the bottle, or aligned at some angle to the bottle.

The invention will now be described in connection with the following drawings wherein like reference numerals have been used to define like parts.

DETAILED DESCRIPTION OF THE PREFERRED EMBODIMENTS

Figure 1:
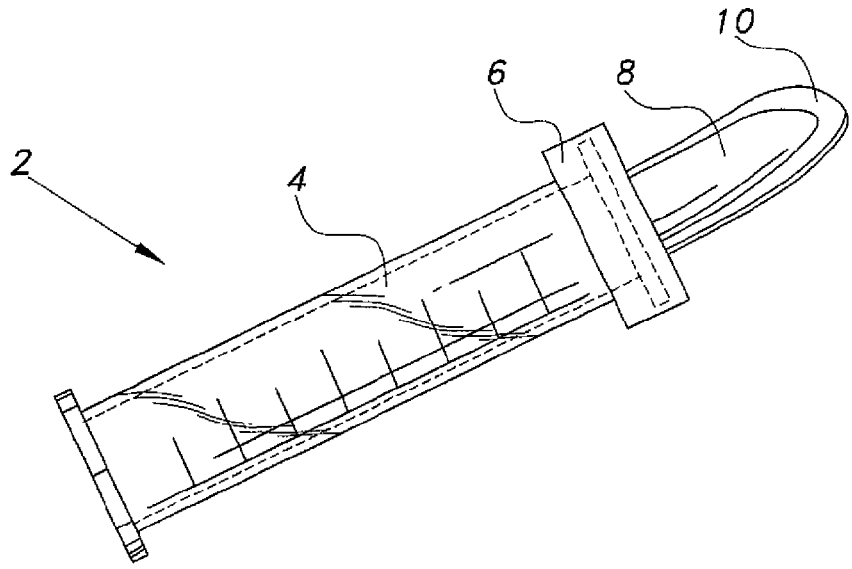
FIG. 1 (PRIOR ART)
FIG. 1 is a side elevational view of a prior art nursing bottle for children with cleft lips and/or cleft palates.

A prior art baby bottle for feeding children with a cleft lip and/or a cleft palate is shown in FIG. 1. As shown, a conventional baby's bottle 2 includes an elongated container 4 having an open end with an external thread (not shown) formed thereon. A conventional cap 6 has an opening therein and an internal threaded portion and a nipple 8 extends therethrough as attached to the top of the bottle in a conventional manner. However, the nipple 8 includes a substantially solid thin shield 10 of latex rubber or the like. The shield 10 is designed and constructed to prevent the nipple from collapsing into a cleft palate.

A nursing bottle 20 in accordance with the present invention includes an upper section 22 having an elongated bottle 24 which is shaped like a conventional baby's bottle and made of glass or suitable plastic material. Like conventional bottles, the elongated bottles are preferably clear or translucent so that a caregiver can monitor the amount of nutrient that is dispensed. The bottle 24 also includes an opening 25 in an upper portion thereof, and a threaded neck 26 surrounds the opening 25. The threaded neck 26 is constructed and dimensioned to receive a threaded cap 28 with a nipple 30 extending through an opening in the cap 28 in a conventional manner. As in a conventional baby's bottle, the nipple 30 includes a peripheral flange at a base thereof. This flange is compressed between a top of the cap 28 and top of the neck 26.

Unlike a conventional baby's bottle, the nursing device 20 includes an elongated tubular member 34, which passes through the nipple from a forward opening in a nipple for delivering liquid, such as milk or water, to an infant. The tubular member may be flexible, semi-flexible or relatively rigid and of a suitable plastic material, and is connected to a small submersible rotary pump for delivering pre-selected amounts of liquid to an infant.

A small rotatable submersible pump 36, the output of which is connected to the tube 34, is disposed in the bottom of the bottle 24. The pump 36 is connected to a motor 38 through a magnetic coupling 40 (shown schematically). The motor 38 is disposed in a lower section 42 of the device.

The lower section 42 includes a plastic housing 44, which is attached to the bottom of the bottle 24 in any conventional manner. A programmable timer 46 of conventional design regulates the motor 38 in order to provide a selected volume of liquid to an infant, and may be programmed to provide small amounts of liquid with intermittent pauses to provide a more natural feeding. A battery 48 is disposed in the lower section 42 for powering the motor 38 and includes means 50 for connecting the batteries to an external charger 52, which is connected to a source of electricity in a conventional manner.

Figure 3:
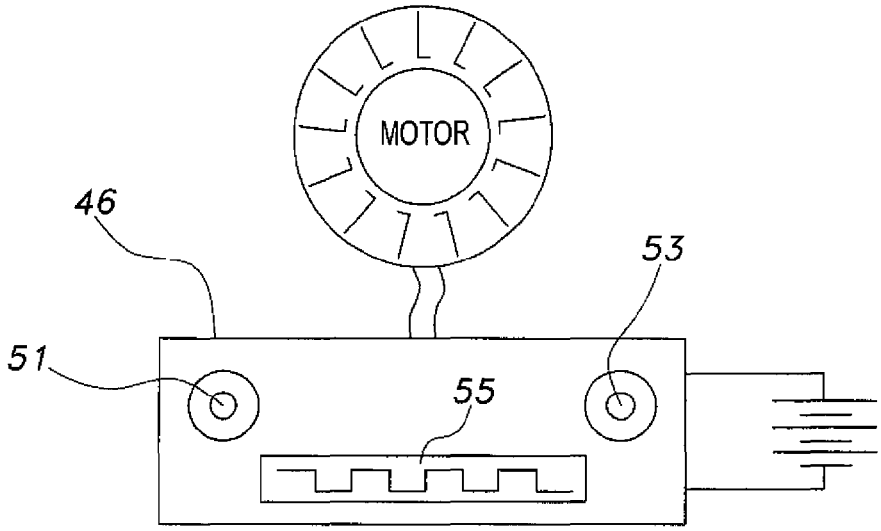
FIG. 3 is a schematic illustration of a programmable timer for use in the present invention.

The programmable timer 46 is shown schematically in FIG. 3 and typically includes a microprocessor control, the programming of which is well within the ability of a person of ordinary skill in the art. The timer is also of conventional design and regulates the volume of liquid pumped and the length of pauses between pumping for each feeding cycle. The volume of liquid may be adjusted by a knob 51, and the timing for a pause by a knob 53. An LED display 55 may also be provided as an indication of volume, as for example, the height or amplitude shown on the display or the pause indicated by ½ wavelength.

Figure 4:
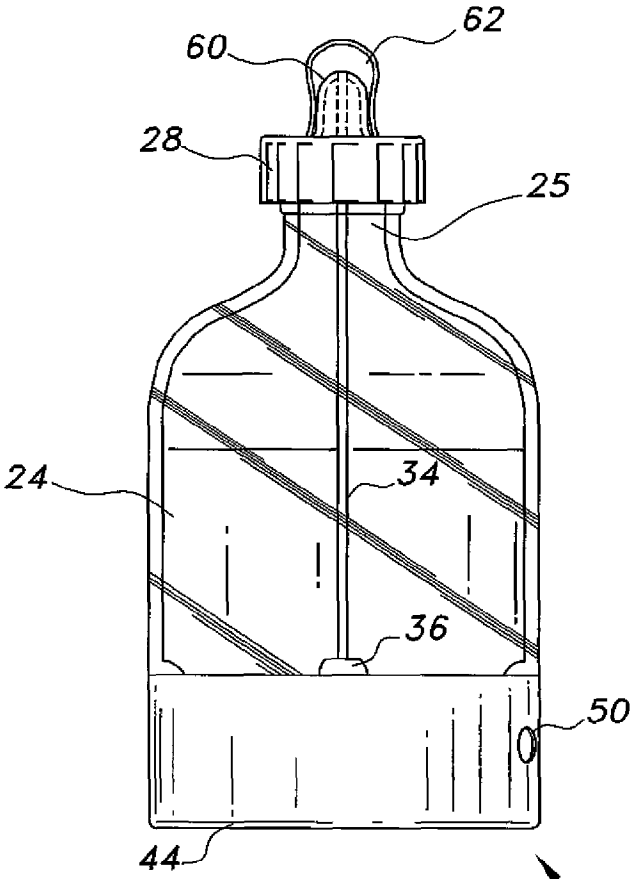
FIG. 4 is a cross-sectional view of a nursing bottle according to a second embodiment of the invention.
Figure 2:
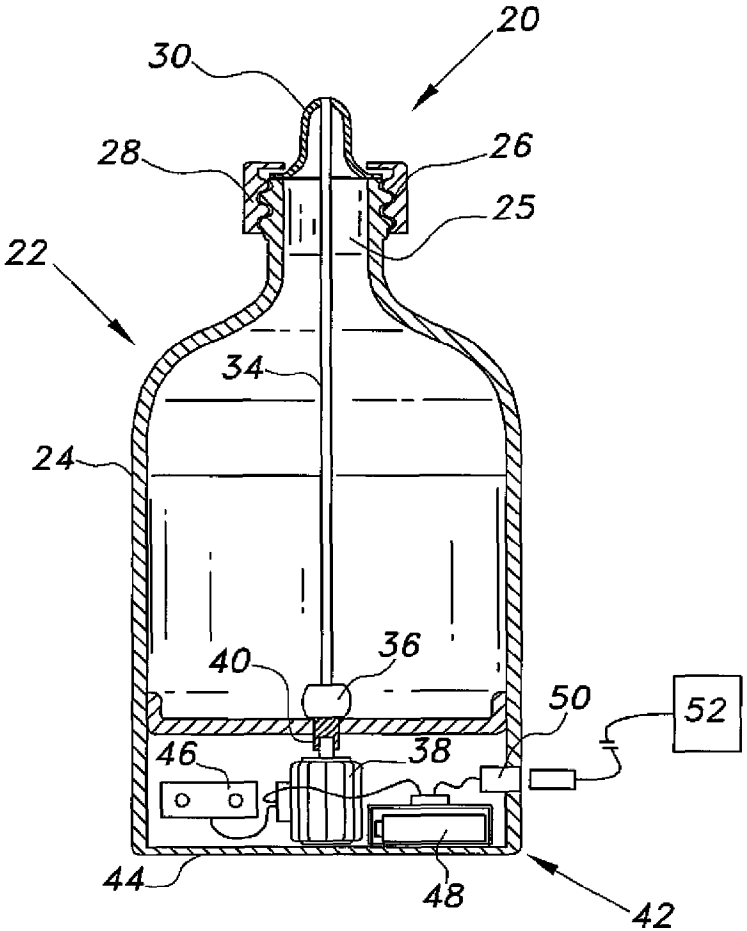
FIG. 2 is a cross-sectional view of a nursing bottle in accordance with the present invention.
Figure 5:
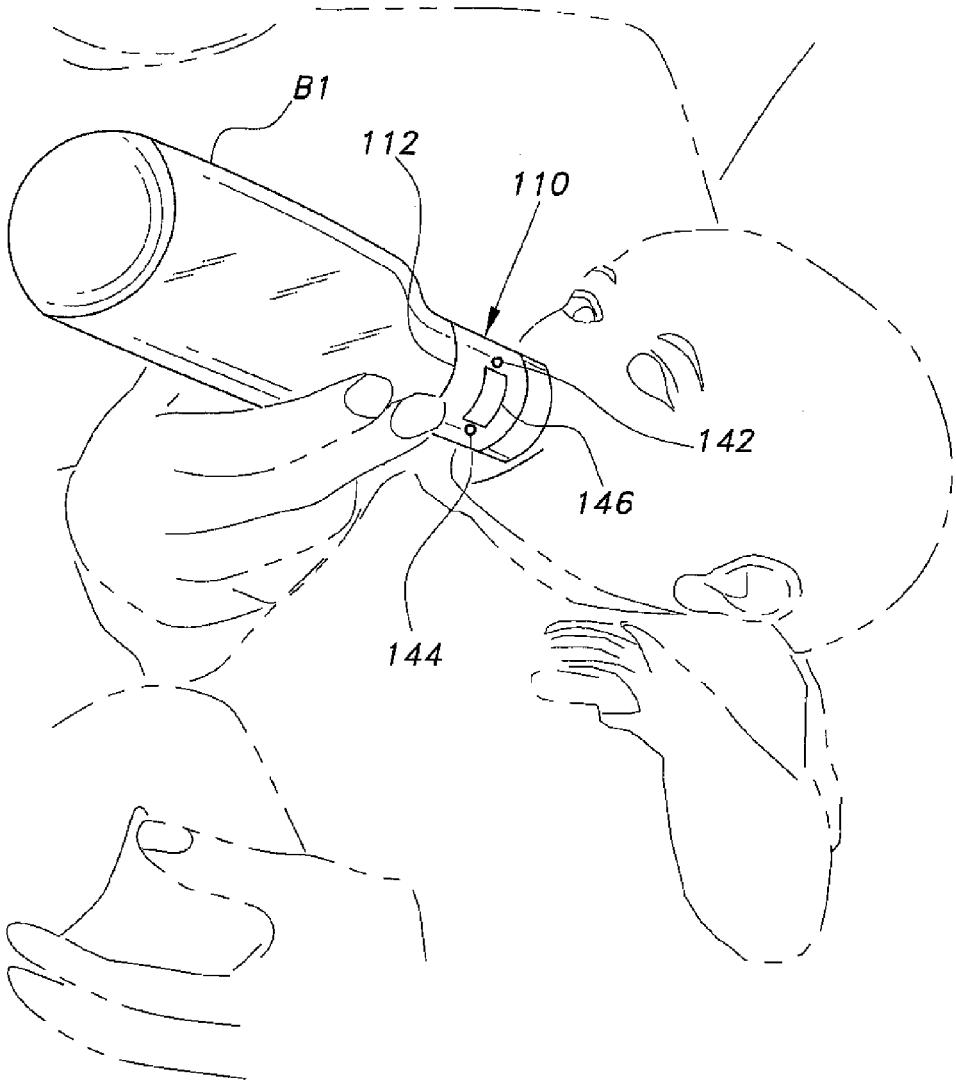
FIG. 5 is an environmental perspective view of a third embodiment of a nursing device according to the present invention, comprising a nursing bottle and attachment being used to feed an infant.

A further embodiment of the invention, which is similar to the first embodiment, is illustrated in FIG. 4. The difference is the nipple 30 shown in FIG. 2 is replaced with a nipple 60 having a soft rubber shield 62 for covering the defect of the baby's mouth to thereby prevent leakage of milk due to a cleft lip or cleft palate.

FIGS. 5 through 8 of the drawings illustrate two additional embodiments of the nursing device, which have a bottle attachment housing enclosing the motor, pump, and controls, the housing being removably threaded in place atop the bottle by means of the conventional externally threaded neck of the bottle. The primary difference between the two embodiments of FIGS. 5 through 8 is in the location of the pump. One embodiment has the pump located within the housing, and the other embodiment has the pump located below the housing, but within the upper volume of the bottle to which the housing is attached.

Figure 6:
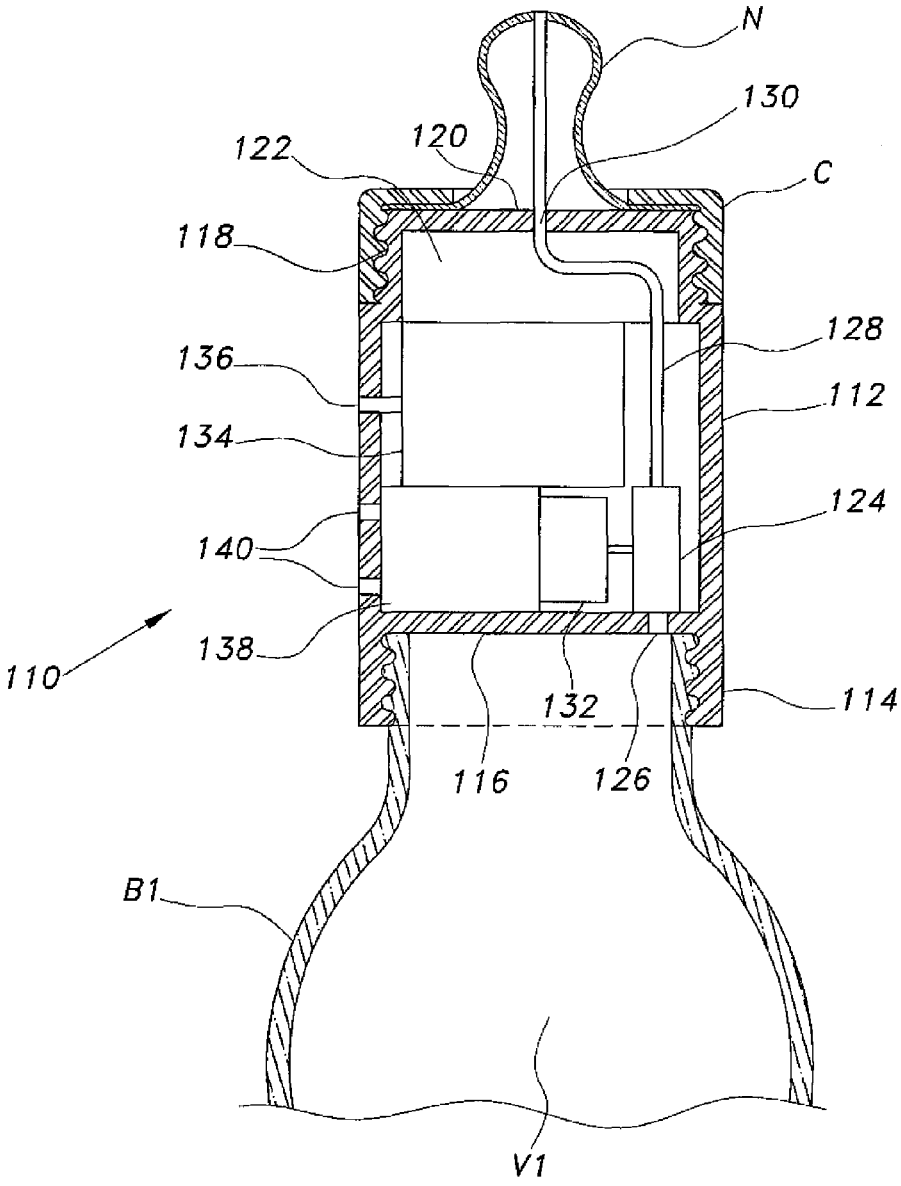
FIG. 6 is a partial side elevation view in section of the nursing device of FIG. 5, showing attachment of a metered liquid dispensing device to a conventional nursing bottle.

FIG. 6 provides a detailed side elevation view in section of an embodiment of a nursing device having a metered liquid dispensing device 110 that has all of the components of the dispensing device 110 contained within or mounted on a bottle attachment housing 112. Each of the various components within the housing 112, which is illustrated schematically in FIG. 6, is conventionally available. The bottle attachment housing 112 has an internally threaded bottle attachment base 114. A floor 116 extends across the housing 112 immediately above the threaded base 114. The threaded base 114 is adapted for attachment to the externally threaded neck of a standard baby bottle, e.g., the bottle B1 of FIGS. 5, 6, and 8, or alternatively, to the angled neck of the bottle B2 shown in FIG. 7. The bottles B1 and B2, or other bottle having an externally threaded neck, may be formed of transparent or translucent glass or plastic material to enable the caregiver to check the contents of the bottle visually.

The opposite upper end of the housing 112 has an externally threaded nipple attachment top 118 having a cover 120 spanning the upper end of the top 118 at the upper limit of the threads. The externally threaded nipple attachment top 118 of the housing 112 is of the same diameter and thread pitch as a conventional baby bottle, e.g., the bottle B1. Thus, it is adapted to accept an internally threaded nipple collar or cap C conventionally used to capture the flange of the nipple N thereunder to secure it to the neck of the bottle B1. The bottle attachment housing 112 defines a substantially sealed interior volume 122 (with the exception of two small passages for the feeding tube, and additional lateral passages for access to controls for the device) for the containment of the operative components of the metering device 110.

The interior 122 of the housing 112 contains a liquid pump 124 that communicates with the interior volume V1 of the bottle B1 by means of a liquid flow inlet passage 126 formed through the floor 116 of the housing 112. The pump 124 is preferably a conventional peristaltic pump, i.e., a continuous liquid delivery line or tube 128 is sealed at or through the inlet passage 126 and extends through the pump 124 and through a delivery line or tube outlet passage 130 through the cover 120 of the housing 112 to extend through the perforated tip of the nipple N. The pump 124 includes one or more rollers therein that travel along a portion of the flexible tube or line 128 disposed within the liquid pump 124 housing, progressively compressing the wall of the tube 128 to convey liquid therethrough. However, other types of pumps may be used in the metering device 110, if desired.

The liquid pump 124 is selectively driven by an electric motor 132 that receives its power from a power supply 134, comprising a preferably rechargeable electrical storage cell or battery pack disposed within the housing 112. A recharging port 136 may be provided through the wall of the housing 112. A control system 138 communicates electrically with the motor 132 and/or power supply 134 to control the power delivered to the motor 132 by the power supply 134, thereby controlling the speed, operating time, pause time, and/or other factors relating to the operation of the liquid pump 124 and its delivery of liquid from the bottle B1. Input to the control system 138 is provided by one or more external control passages 140 disposed through the sidewall of the housing 112.

Figure 8:
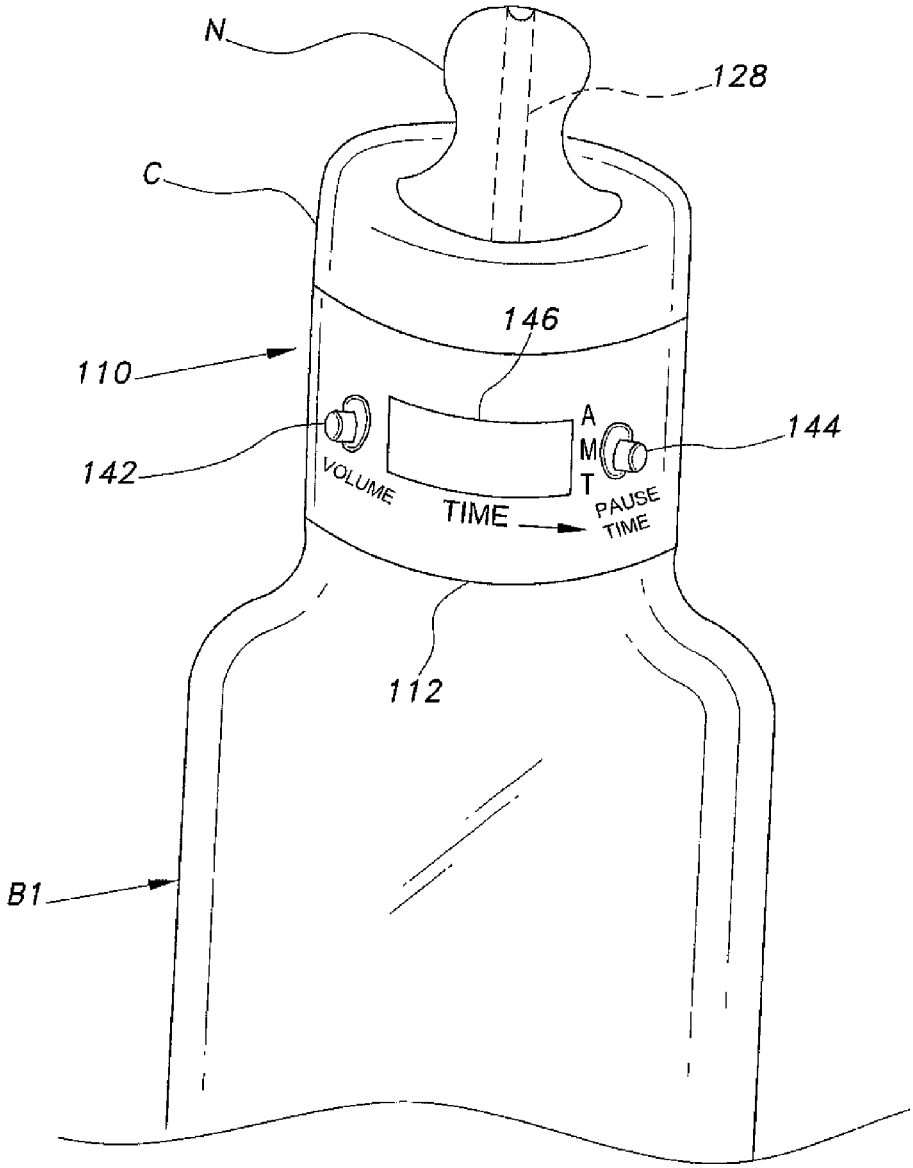
FIG. 8 is a partial perspective view of the nursing device of FIG. 6, showing an exemplary external control array.

FIG. 8 provides a perspective view of the metered liquid dispensing device 110 of FIG. 6, illustrating an exemplary configuration of its external controls and display. The natural sucking action of a normal infant results in a series of liquid pulses entering the mouth of the infant. The pause between pulses provides time for the infant to swallow. However, an infant with a cleft lip or palate is incapable of producing the suction required to draw the liquid from the bottle without assistance. Accordingly, the present nursing device in its various embodiments provides a pump to deliver positive liquid flow from the nipple of the bottle in a series of intermittent pulses simulating the natural sucking reflex of an infant and giving the infant time to swallow after each pulse. The controls for the metering device 110 include a volume control 142 that allows the caregiver to adjust the rate of flow or volume of each pulse of liquid delivered, and a pause timer control 144 to adjust the time between each pulse of liquid. A display 146 is provided to enable the caregiver to visually determine the magnitude of each pulse of liquid, the duration of the pulses, and the time interval between pulses. The controls 142 and 144 and the display 146 are conventional, such controls and display being well known in the art of microcomputerized pump controls.

Figure 7:
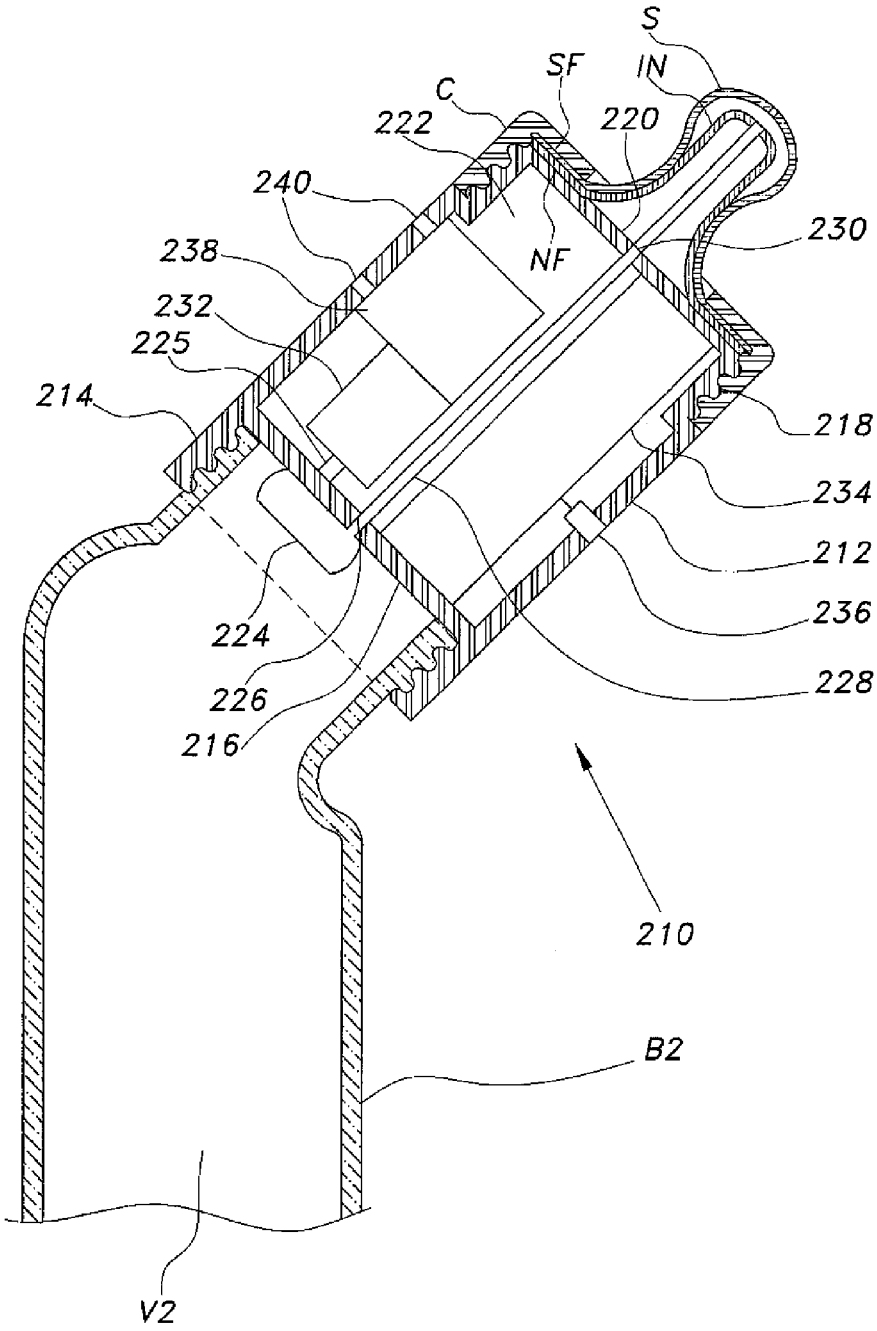
FIG. 7 is a partial side elevation view in section of a fourth embodiment of a nursing device according to the present invention, showing a metered liquid dispensing device attached to a nursing bottle having an angularly displaced neck.

FIG. 7 of the drawings provides a side elevation view in section of an alternative embodiment of the metered liquid dispensing device, designated as metering device 210. The metering device 110 comprises a bottle attachment housing 212 having a configuration similar to the bottle attachment housing 112 illustrated in detail in FIG. 6, i.e., having an internally threaded bottle attachment base 214 that has a floor 216 extending across the housing 212 immediately above the threaded base 214 adapted for attachment to the conventional externally threaded neck of a standard baby bottle, e.g., the angled neck of the bottle B2 shown in FIG. 7, or alternatively, to the straight neck of the bottle B1, illustrated in FIGS. 5, 6, and 8.

The opposite upper end of the bottle attachment housing 212 has an externally threaded nipple attachment top 218 having a cover 220 spanning the upper end of the top 218 at the upper limit of the threads. The externally threaded nipple attachment top 218 of the housing 212 is of the same diameter and thread pitch as a conventional baby bottle, e.g., the bottle B2 in order to accept a conventional internally threaded nipple attachment collar or cap C to capture the flange of the nipple thereunder and secure the nipple to the neck of the bottle B2. However, the embodiment illustrated in FIG. 7 includes an inner nipple IN having a nipple flange NF captured between the nipple attachment cap C (or more precisely, beneath the overlying shield flange SF that is, in turn, captured beneath the cap C) and the underlying nipple attachment top 218 (and the outer portion of the cover 220 formed integrally with the top 218). The metering device 210 also includes an outer shield S over the inner nipple IN. The shield S has a shield flange SF captured between the overlying nipple attachment cap C and the nipple attachment top 218 and cover 220, or more precisely between the cap C and the underlying inner nipple flange IF. The shield S serves to prevent the collapse of the relatively soft inner nipple N.

The bottle attachment housing 212 defines a substantially sealed interior volume 222 (with the exception of two small passages for the feeding tube, and additional lateral passages for access to controls for the device) for the containment and mounting of the operative components of the device 210. The metered liquid dispensing device 210 differs from the metering device 110 in that the liquid pump 224 is disposed external to the housing 212 and below the floor 216, so that the pump 224 is within the interior volume V2 of the bottle B2 when the metering device 210 is installed thereon. The pump 224 is preferably a peristaltic pump, as described further above in the discussion of the metering device 110 of FIG. 6. A passage 226 is provided through the floor 216 of the housing 212, and a liquid delivery line or tube 228 extends from the pump 224 through the passage 226 in the floor 216, through the interior of the housing 212 and through the delivery line tube outlet passage 230 in the cover 220 of the housing 212. The delivery line or tube 228 extends at least through the perforated tip of the inner nipple IN, and terminates in the space between the inner nipple IN and the outer shield S in the embodiment 210 of FIG. 7. However, the delivery line 228 may be extended to the perforated tip of the shield S, if desired.

The pump 224 is selectively driven by an electric motor 232 that is disposed within the interior volume 222 of the housing 212, i.e., on the opposite side of the floor 216 from the pump 224. No passage for a driveshaft between the motor 232 and the pump 224 is provided, in order to minimize the number of passages and corresponding potential leaks through the floor 216. Rather, a magnetic drive 225 is provided between the motor 232 and the pump 224. The drive utilizes a magnet with a rotating polarity driven by the motor 232. A corresponding magnet or ferromagnetic component at the pump 224 is driven by the rotation of the drive magnet. Such magnetic drives are conventional, and are well known in the field of small motor drive systems.

The motor 232 receives its power from a power supply 234, comprising a preferably rechargeable electrical storage cell or battery pack disposed within the housing 212. A recharging port 236 may be provided through the wall of the housing 212. A control system 238 communicates electrically with the motor 232 and/or power supply 234 to control the power delivered to the motor 232 by the power supply 234, thereby controlling the speed, operating time, pause time, and/or other factors relating to the operation of the liquid pump 224 and its delivery of liquid from the bottle B2. Input to the control system 238 is provided by one or more external control passages 240 disposed through the sidewall of the housing 212. The external appearance of the control system of the metered liquid dispensing device 210 may be substantially similar to the control system illustrated in FIGS. 5 and 8.

It will be seen that many of the various components of the various embodiments illustrated in FIGS. 5 through 8 are interchangeable with one another, e.g., the metered liquid dispensing device embodiment 110 may be installed upon either bottle type B1 or B2, or other suitable bottle configuration as desired. Moreover, the inner nipple IN and shield S may be used nursing device of FIG. 6, if desired. The external appearance of the metered liquid dispensing device in the embodiments of FIGS. 5 through 8 is unobtrusive, thus enabling the caregiver of an infant requiring such a device to use the device without attracting undue attention. This provides much greater comfort and peace of mind to the caregiver, and further encourages the caregiver to enter social situations and expose the infant thereto without concern that the action of bottle feeding the infant will be seen as other than a normal or usual procedure.

While the invention has been described in connection with its preferred embodiments, it should be recognized that changes and modifications may be made herein without departing from the scope of the appended claims.

I claim:

1. In combination, a baby bottle and a metered liquid dispensing device for attachment thereto, the combination comprising:

a baby bottle, the baby bottle having a first portion extending in a first direction and having a first predetermined length, a second portion defining a threaded neck portion, wherein the length of the neck portion is less than and aligned with the first predetermined length;

a metered liquid dispensing device, the metering device including a baby bottle attachment housing having an internally threaded bottle attachment base having a floor extending across the base, the floor having an upper surface and a lower surface, the base being adapted for attachment to the threaded neck portion, and an externally threaded nipple attachment top opposite the base, the top being adapted for attachment of a nursing bottle cap thereto;

an internally threaded nipple attachment cap removably secured to the nipple attachment top of the housing;

an inner nipple having a flange removably captured between the nipple attachment cap and the nipple attachment top of the housing, an elongate, hollow nipple protrusion extending from the nipple flange, the nipple protrusion having a tip end defining a single orifice for the delivery of liquid through the orifice, wherein the remainder of the inner nipple is imperforate;

an outer shield having a flange removably captured between the nipple attachment cap and the nipple attachment top of the housing, the outer shield being disposed over the inner nipple, the shield having a circular shield flange overlying the nipple flange and an elongate, hollow shield protrusion enclosing the nipple protrusion, the shield protrusion having a tip end defining an orifice for the passage of liquid therethrough, wherein the shield prevents collapse of the nipple protrusion and defines a temporary reservoir between the nipple protrusion and the shield protrusion for liquid dispensed from the nipple protrusion;

a liquid pump directly attached to the upper surface of the floor;

a single liquid delivery line extending from the pump through the housing and extending through at least the inner nipple;

an electric motor disposed within the housing, the motor having a magnetic drive mechanically coupling the motor to the pump for selectively operating the pump;

a control system disposed within the housing, the control system selectively operating the motor; and a power supply disposed within the housing, the power supply selectively providing electrical power to the motor in accordance with input from the control system.

2. The combination according to claim 1, wherein:

the liquid pump is a peristaltic pump; and the control system includes flow rate and pause controls.

3. The combination according to claim 1, wherein the baby bottle is formed of a material selected from the group consisting of glass and translucent plastic.

4. The combination according to claim 1, wherein the power supply comprises a rechargeable battery.

5. The combination according to claim 1, wherein the control system attached to the liquid pump, the control system having means for activating the liquid pump to deliver the liquid through the liquid delivery line to the orifice in a programmable measured volume and at programmable time intervals.

* * * * *